US009120236B2

(12) United States Patent
Cardenas

(10) Patent No.: US 9,120,236 B2
(45) Date of Patent: Sep. 1, 2015

(54) COMBINATION FOLDING TOOL AND METHOD OF HANDLE DEPLOYMENT

(76) Inventor: Julio Cesar Herrera Cardenas, Norwalk, CT (US)

( * ) Notice: Subject to any disclaimer, the term of this patent is extended or adjusted under 35 U.S.C. 154(b) by 764 days.

(21) Appl. No.: 13/457,043

(22) Filed: Apr. 26, 2012

(65) Prior Publication Data

US 2012/0284929 A1 Nov. 15, 2012

Related U.S. Application Data

(60) Provisional application No. 61/484,225, filed on May 10, 2011.

(51) Int. Cl.

| | |
|---|---|
| ***B26B 11/00*** | (2006.01) |
| ***B25F 1/00*** | (2006.01) |
| ***B25F 1/04*** | (2006.01) |

(52) U.S. Cl.

CPC ..... *B26B 11/003* (2013.01); *B25F 1/003* (2013.01); *B25F 1/04* (2013.01)

(58) Field of Classification Search

CPC ..... B26B 13/00; B26B 13/005; B26B 13/28; B26B 11/003; B25B 7/06; B25B 7/00; B25B 7/4704; B25F 1/003; B25F 1/04

USPC ..... 7/118, 125, 127, 135, 128; 81/415, 416, 81/177.8, 177.1, 177.6, 440, 490

See application file for complete search history.

(56) References Cited

U.S. PATENT DOCUMENTS

| | | | | |
|---|---|---|---|---|
| 1,467,661 | A | 9/1923 | Undy | |
| 4,238,862 | A * | 12/1980 | Leatherman | 7/128 |
| 4,367,778 | A * | 1/1983 | Bradbury | 81/23 |
| 4,744,272 | A | 5/1988 | Leatherman | |
| 5,062,173 | A * | 11/1991 | Collins et al. | 7/118 |
| 5,142,721 | A * | 9/1992 | Sessions et al. | 7/128 |
| 5,212,844 | A | 5/1993 | Sessions | |
| 5,267,366 | A * | 12/1993 | Frazer | 7/128 |
| 5,491,856 | A * | 2/1996 | Legg | 7/128 |
| 5,564,318 | A * | 10/1996 | Pail | 81/427.5 |
| 5,697,114 | A * | 12/1997 | McIntosh et al. | 7/129 |
| 5,791,002 | A * | 8/1998 | Gardiner et al. | 7/128 |
| 5,809,600 | A * | 9/1998 | Cachot | 7/128 |
| 6,101,654 | A * | 8/2000 | Cachot | 7/128 |
| 6,357,068 | B1 * | 3/2002 | Seber et al. | 7/129 |
| 2003/0126748 | A1 * | 7/2003 | Cachot | 30/255 |
| 2009/0000038 | A1 * | 1/2009 | Padden | 7/128 |

* cited by examiner

*Primary Examiner* — Monica Carter
*Assistant Examiner* — Melanie Alexander
(74) *Attorney, Agent, or Firm* — Tran & Associates

(57) ABSTRACT

A combination folding tool includes opposable handles that move from an adjacent position during storage to an extended perpendicular position, and a tool head that is axially positioned during use and is stored between the opposable handles during storage.

21 Claims, 9 Drawing Sheets

COMBINATION FOLDING TOOL AND METHOD OF HANDLE DEPLOYMENT

This application claims priority to Provisional Application Ser. No. 61/484,225, filed May 10, 2011, the content of which is incorporated by reference.

BACKGROUND OF THE INVENTION

The present invention relates generally to multifunctional folding tools.

DESCRIPTION OF RELATED ART

Multifunctional folding tools are commonly used to carry a certain quantity of tools in a small form for various uses either at home, in the working place, outdoor activities or sporting applications, and so on. At times users complain about uncomfortable handles in either an open or closed disposition, difficult accessibility of tools, jaw mechanisms that are complex or of small size, and excessive weight or volume of multifunctional folding tools. It is understandable that these methods are inadequate at times for example when a user needs larger sized pliers in a pocket size tool, the alternative being having to carry a big folding tool, which in effect destroys the purpose of having a compact size. Also, it is understood that using a folding tool for longer periods of time comfortable handles are desirable. Last, it is desirable to have a folding tool that is compact and without excessive weight or volume.

The use of certain prior art products such as the combination tool sold by Leatherman and described to some extent in U.S. Pat. Nos. 4,238,862 and 4,744,272, the handles fold open with a complex motion in the plane of the plier's movement and requires the user to grasp exposed channel edges of the handles when operating the pliers. In the combination tool sold by Gerber and described in U.S. Pat. Nos. 5,142,721 and 5,212,844, the pliers head is slidably deployed from the handles and does not permit the handles to be opened to lie in a straight line, so that the use of the blade tools folded open from the handles is awkward in some instances and there is a risk of pinching the hand when the pliers are used. In the Paratool combination tool sold by SOG Specialty Knives and described in U.S. Pat. No. 5,267,366 and U.S. Pat. No. 5,062,173, the handles fold in the same direction out of the plane of the pliers movement and the pliers head is not easily moved between the nested and deployed dispositions, requiring a tab attachment to aid in the deployment. The SOG Paratool also produces an asymmetric clamping force when pressure is applied to the pliers head through the handles. In all cases, deployment of the pliers head can be difficult in some situations, such as when the user is wearing gloves.

In addition, the use of jaw mechanisms like pliers, scissors, wire cutters, etc. in pocket knives is very common but the sizes are typically small. Some companies like Wenger have taken an approach to this problem with U.S. Pat. No. 20030126748A1, which foldable tool requires an extra handle to allow the use of the jaw head which adds complexity, volume and weight to the knife. Another example of the same manufacturer are U.S. Pat. No. 6,101,654 and U.S. Pat. No. 5,809,600A. Yet another approach that addresses this problem to some extent is described in U.S. Pat. No. 5,564,318, but it produces asymmetrical and uncomfortable tool handles. A combination folding tool that overcomes the numerous problems associated with prior art would be valuable to these trades and many others.

SUMMARY OF THE INVENTION

Aspects of the combination tool can include one or more of the following. In one aspect, a combination folding tool includes opposable handles that move from an adjacent position during storage to an extended position, and a foldable tool head that is axially positioned during use and is stored between the opposable handles during storage.

In a second aspect, a combination folding tool includes opposable handles that move from an adjacent position during storage to an extended position, and a foldable tool head that is stored between the opposable handles during storage, and where the foldable tool head is connected axially at an angle respect the tool plane and that allows the handles at open position to be at a 90 degrees with the tool head plane.

In another aspect, a method for using a tool with a foldable head and opposable handles includes moving the opposable handles from an adjacent position during storage to an extended position, and axially positioning the foldable head during use and storing the foldable head between the opposable handles during storage In implementations of the aspects, the combination folding tool includes two articulated levers actuating for example blades or jaws, such as scissors, shears, pliers, pincers, etc. and handles. The jaw mechanism and the handles deploy by rotation in opposite directions about axles lying in the jaw mechanism. The system combines a folding tool with versatile, comfortable handles that may be applied in a multitude of configurations and may employ a multitude of different types of tools and tool heads. A jaw mechanism in a tool of the system may be maintained in a closed configuration and may be full-sized or even much larger than traditional tool heads. All the while the combination tool of the system is maintained in a compact disposition without adding excessive volume and weight to the tool. The combination tool of the system may also be used for tool heads without jaws, but where a compact, lightweight, design is desired along with full-sized and/or stronger handle assemblies.

The system is may be made of assembled metal parts or high strength plastic parts as the case may be. All the jaw mechanism parts as well as any other tools or tool parts may be either machined, stamped, cast, forged or any other process for metal forming including process and treatments for improving strength, hardness, corrosion resistance, etc. For several or certain parts and implements, steel will be preferably though other metals or alloys can be used depending of their properties and how they benefit the overall performance of the tool, also certain materials may be used to create or give certain models a special advantage either for use in a specific process or activity, or for mere aesthetical reasons, allowing the tool to be more efficient, practical and comfortable in use or to carry. Additional benefits to the system are it presents the user a folding tool which has both the characteristics of a multitool, having a strong jaw mechanism in a compact, pocket friendly form similar to a pocket knife dimension with the versatility that users don't need to decide between carrying one or the other.

Another aspect of the present tool is that a novel method in which the handles are deployed allows the concealment of a jaw mechanism or any other tool in a comfortable and yet practical, compact form in both the open and closed disposition without adding extra volume or weight to the tool. A user is thus able to conveniently carry the system and then quickly, instinctively put it in use.

Advantages of implementations of the preferred embodiments may include one or more of the following:

1) A folding tool with opposable handles and a self-contained tool head.
2) A folding tool with an axially positioned tool head.
3) A folding tool with an axially positioned tool head and opposable handles.
4) A folding tool that may accompany an array of larger tool head sizes.
5) A folding tool that may unfold, be put into use, and provides substantial power to perform a desired operation or function.
6) A folding tool with opposable handles that rotate in such a way that are oppositely deployed from an adjacent position to an extended position.
7) A folding tool with opposable handles that rotate in such a way that are oppositely deployed from an adjacent position to the tool head to an extended perpendicular position at 90 degrees respect to the tool plane;
8) A method for folding and unfolding a tool with handles that allows the handles to be oppositely deployed from an adjacent position;
9) A method for folding and unfolding a tool with handles that allows the handles to be oppositely deployed from an adjacent position to the tool head to an extended perpendicular position at 90 degrees respect to the tool plane;
10) A folding tool that presents the same handle configuration in either open or closed form;
11) A folding tool that present comfortable handles in every configuration open or closed;
12) A folding tool that allow the access to every tool in the handles in closed configuration.

Furthermore, it is an object of this application to illustrate the preferred embodiments and broadly state the methodologies that may be used in order to provide a comfortable and practical folding tool with a novel handle deployment method allowing the user to have the same handle configuration in open or closed disposition and in a portable compact form.

DETAILED DESCRIPTION OF THE INVENTION

A. Description of the System

Figure 1:
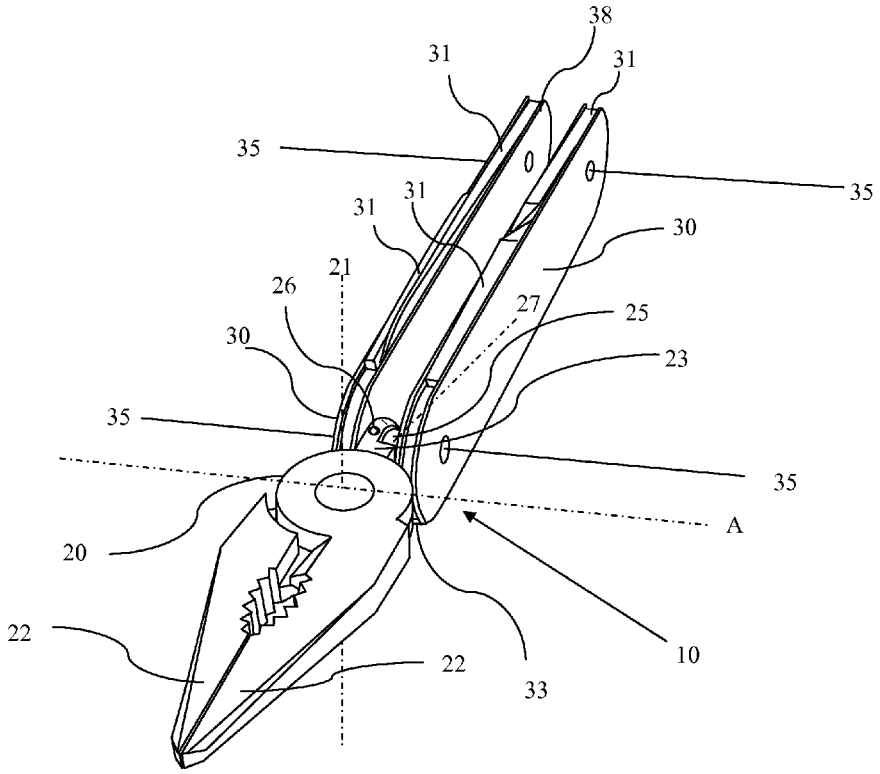
FIG. 1 is a perspective view of the system in open configuration illustrating the components that make up the preferred embodiments and their related elements.
Figure 10:
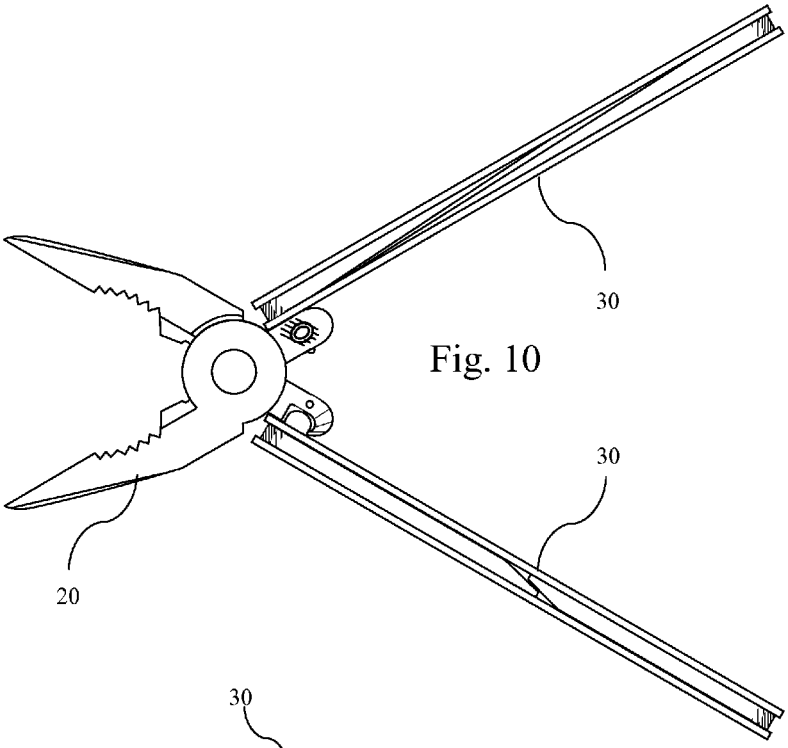
FIG. 10 is a view of the system ready for use with the jaw mechanism 20 open and both handles 30 deployed in full open disposition
Figure 11A:
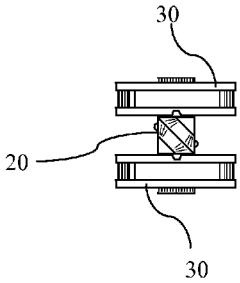
FIG. 11A is a back view of the system ready for use with the jaw mechanism 20 closed and both handles 30 deployed in fully open disposition
Figure 11:
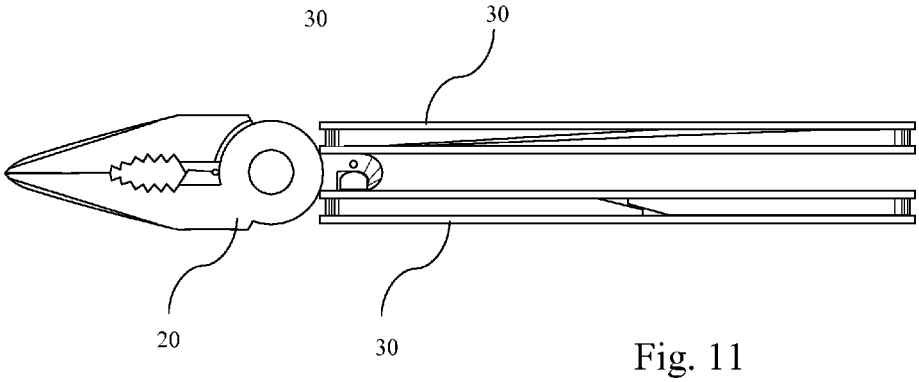
FIG. 11 is a view of the system ready for use with the jaw mechanism 20 closed and both handles 30 deployed in full open disposition

FIG. 1 illustrates a combination tool 10 in accordance with the preferred embodiment with each of its implements in projected or partially projected disposition. Such tool includes opposing cooperating jaw members 22 connected by a pivot 21 for swinging movement of working end portions 22 of such jaw members relatively toward and away from each other. For ease of explanation, the tool head described herein is as jaw members are pliers jaws with the working end portions being swingable from a closed disposition (clamped closed) to an open disposition as illustrated in FIG. 10 in which the facing surfaces of the working end portions 22 are clamped. Each jaw member 22 includes a tang or lug portion 23 extending from the pivot 21 oppositely from the corresponding working end position 22.

The lug portion 23 of the jaws are connected to elongated handles 30 by pivots 25 which extend at a predetermined angle. A typical angle with the opposing handles may be between 30-60 degrees, however any angle may be suitable depending on the nature of the tool head that is used and the desired performance as well as the actual handle design. Each handle rotates around the axis of its pivot 25 relative to the jaw of member 23 to which it is connected. The use of pivots is commonly used for tools but may also incorporate any number of axially disposed components or any other form of slidable, movable component(s) as the case may be. Likewise the handle construction may be in a multitude of shapes and forms with the only provision is they allow a tool head to be fixed in an internal location and removably extracted in part or in whole. The handle may even be a single piece, or a two piece cover that splits in two to provide a subsequent pinching action. The various components and elements comprising the system 10 may be made of any form of metal, plastic, wood, or the like, suitable for the job to be performed and which meets the performance desired.

The tool head as described in the figures herein generally reflect a jaw mechanism such as a pliers, but may be any type of tool head imaginable whereas it would be advantageous to collapse it into a compact form and to quickly extract and use. The tool head in its axial, slideable or movable disposition may include any number of methods of being affixed to its handles and any number of means of axially, slidably, or movably being extracted, as the case may be.

In the open disposition shown in FIG. 10, each handle forms an extension of the jaw member tang or lug 23 to which such handle is connected. The method in which the handles are connected to the jaw mechanism permits the handles 30 to be deployed from a closed position lying adjacent to the tool head 20, to an open extended position lying perpendicular to the tool head plane. This novel method of handle deployment also allows the handles to maintain the same grip configuration in both open or closed disposition adding the benefit of improved comfort to the user in either open or closed configuration. Preferably, each handles 30 receive pocket knife implements 31 which preferably are connected by pivots 35 to the end portions of the handles 30. When retracted the implements are fitted between the handles plates 38. Such plates can have finger notches for access to the edge portions of the retracted implements. Preferably, the base of each implement is engaged by a leaf spring 33 The leaf spring also can limit the degree to which an implement can be swung open by engaging in a notch in the base of an implement when such an implement has been swung so as to extend substantially longitudinally away from its handle. As is understood, the use of any leaf spring may also be accomplished by any number of other spring-type components and methodologies.

Figure 2:
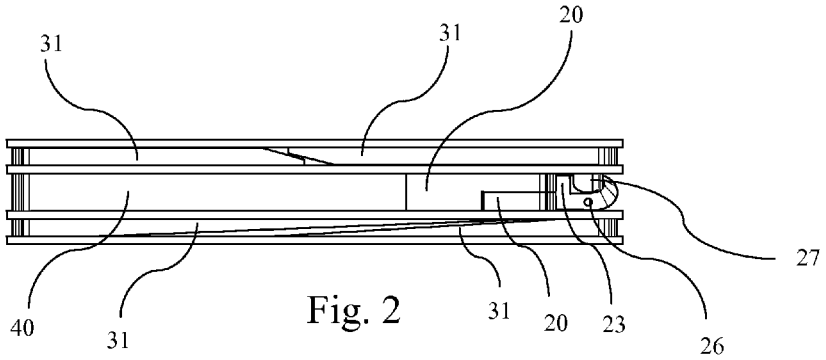
FIG. 2 is a side view of the system in closed configuration and having a jaw cover 40 (jaw mechanism cover attachment) for helping maintaining the jaw mechanism clamped for use in closed configuration.

FIG. 2 of the system 10 consists of a side view of the tool in closed disposition showing all the tool components in a preferred embodiment for use as a pliers, including a tool head cover attachment 40 which help maintain both jaws extension 22 in closed clamping engagement. In addition the tool head cover attachment 40 also help maintain the tool handles 30 in its closed disposition as its shown in next figure.

Figure 3:
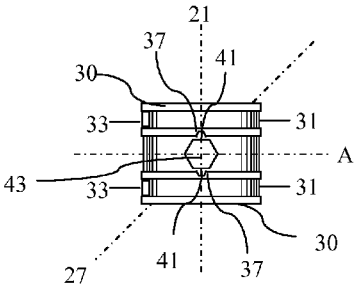
FIG. 3 is a front view of the system showing the jaw mechanism cover attachment

FIG. 3 of the system 10 consists of a front view of the tool in FIG. 2 showing the tool components, including the tool head cover attachment 40 which maintains both jaws extension 22 in closed clamping engagement. In addition the tool head cover attachment helps maintain the tool handles in closed disposition preferably by top and bottom tabs 47 attached to small handle notches 37 that are preferably present in both handles 30. Thus this impedes the tool handles 30 and the tool head 20 to move from its closed and clamping configuration during the use or carry of the tool in closed configuration until the cover 40 is removed. This tool head cover attachment 40 can also preferably have other tools or functions integrated like for example a hex bit driver hole 43.

Figure 4:
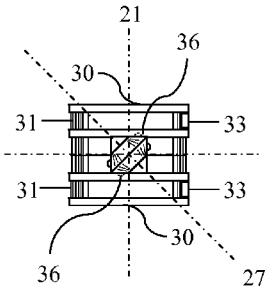
FIG. 4 is a back view of the system showing the jaw mechanism lugs 23 and the novel method in which the handles are attached to it.

FIG. 4 of the system 10 consists of a back view of the tool in FIG. 2 showing the tool components, including a back view of the novel method in which both handles 30 are attached by pivots 25 to the jaw mechanism tangs 23.

B. Description of the System Prepared for Use

Figure 5:
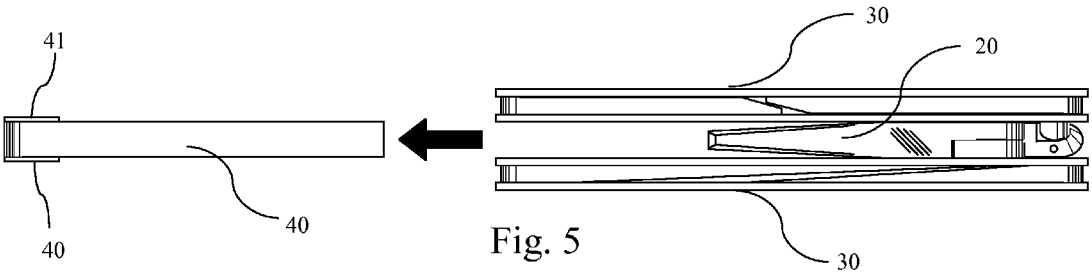
FIG. 5 is a side view of the system being prepared for use with the jaw mechanism cover attachment 40 being removed
Figure 6:
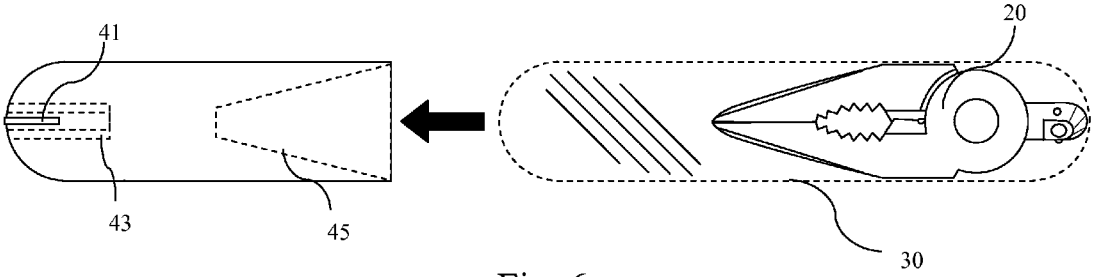
FIG. 6 is a top view of the system being prepared for use with the jaw mechanism cover attachment 40 being removed and showing the top handle 30 in phantom
Figure 7:
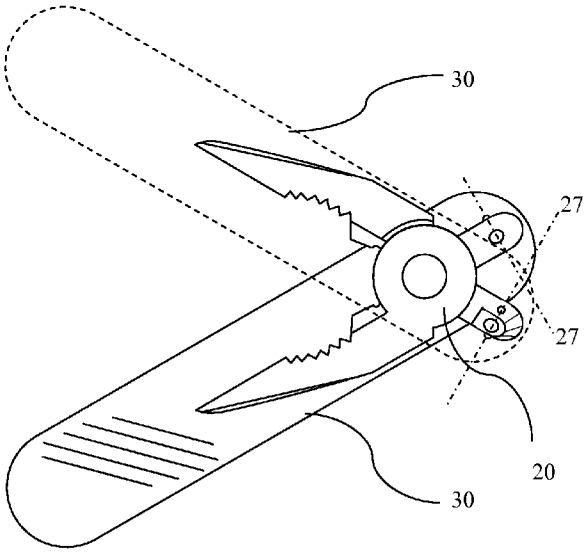
FIG. 7 is a top view of the system being prepared for use with the top handle 30 in phantom and the jaw mechanism 20 being opened

In FIG. 5 the system is shown being prepared to be used, showing the tool cover attachment being removed to allow the jaw mechanism to open, thus allowing the handles to swing from closed adjacent position to a extended full open disposition FIG. 6 is the same as FIG. 5 with the system shown from top as being prepared to use in its open configuration, showing the head cover attachment 40 being removed to allow the jaw mechanism 20 to open, thus allowing the handles 30 to swing from closed to fully open disposition In FIG. 7 the system is shown with the tool head 20 being opened to allow the handles 30 to swing from closed position to fully open disposition. Each handles have a notch 36 that fits in a corresponding tab on the tangs 26 of the jaw mechanism head, this to help maintain the handles 30 in open or closed form depending of the configuration the tool is used.

Figure 8:
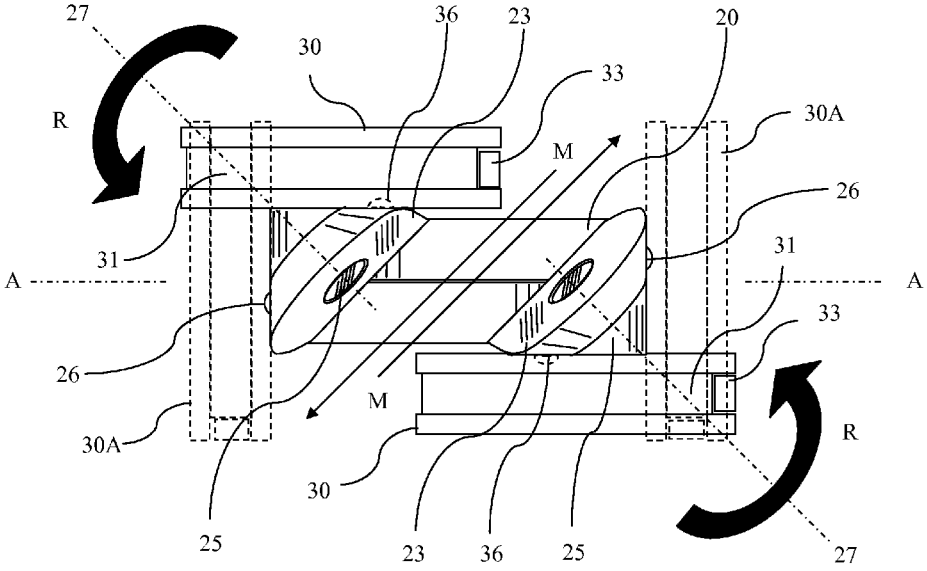
FIG. 8 is a detail view showing the back of the jaw mechanism of the system describing the movement of the handles 30 from closed to open disposition 30A as it is being prepared for use
Figure 9:
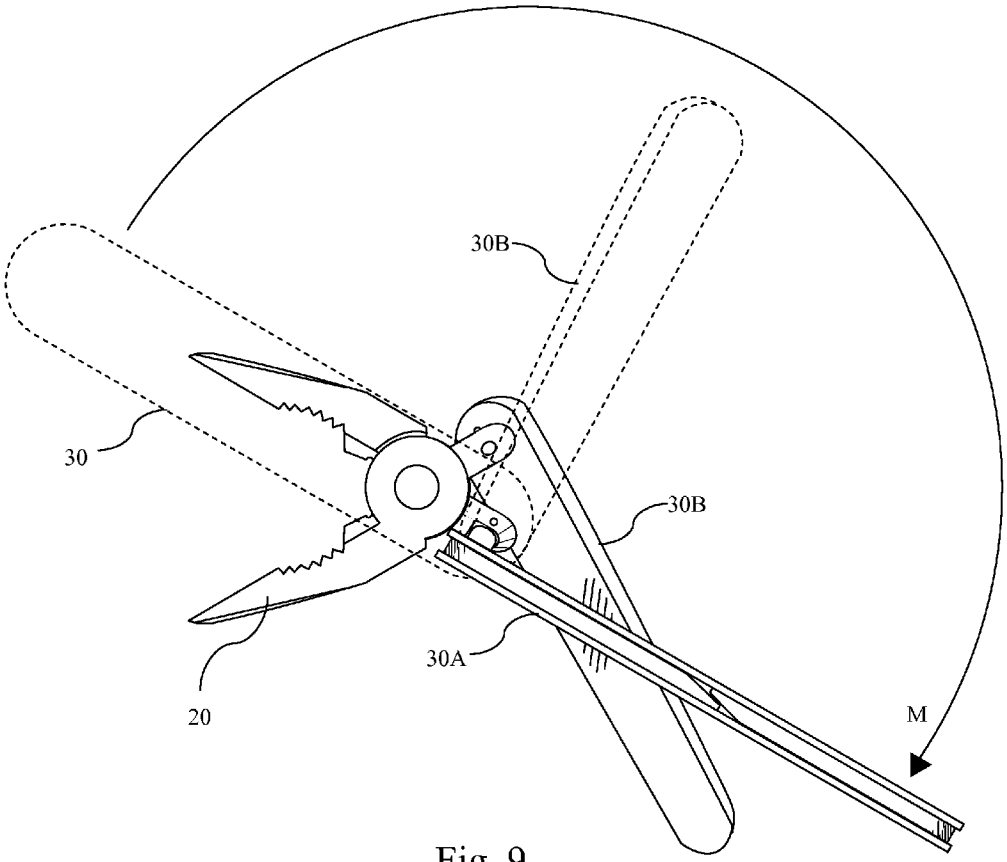
FIG. 9 is a top view of the system being prepared for use showing the movement of the handle 30 going from closed to open disposition 30A and the bottom handle 30' in half open disposition 30B

FIG. 8 of the system shows a schematic view of the novel method in which the jaw mechanism 20 is attached to the handles 30 allowing it to rotate from adjacent position to the tool head to an extended perpendicular position to the tool head plane A, C. Method of Use In FIG. 5 thru FIG. 11 the system is put into use by unlocking or removing any device or any part or mechanism that help maintain the tool in closed configuration. Then the top handle 30 and bottom handle 30' are rotated from its closed disposition by describing an arch around the axis of the pivot 25 by which they are connected to the jaw mechanism tangs 23, the pivot 25 of each handle 30 is attached in such an oblique angle that allows a movement of the handles 30 from a closed adjacent position to an extended position at 90 degrees with the tool plane A. For example in FIG. 9 The handle 30 follows the direction of the movement arrow M showing intermediate positions 30B as it is being deployed from a closed to open configuration. This method of handle deployment allows a smooth transition movement from and adjacent position to an extended and perpendicular position to the tool plane. This novel method creates a movement of gradual transition from a closed adjacent disposition to a perpendicular open disposition of the tool handles 30.

Figure 12:
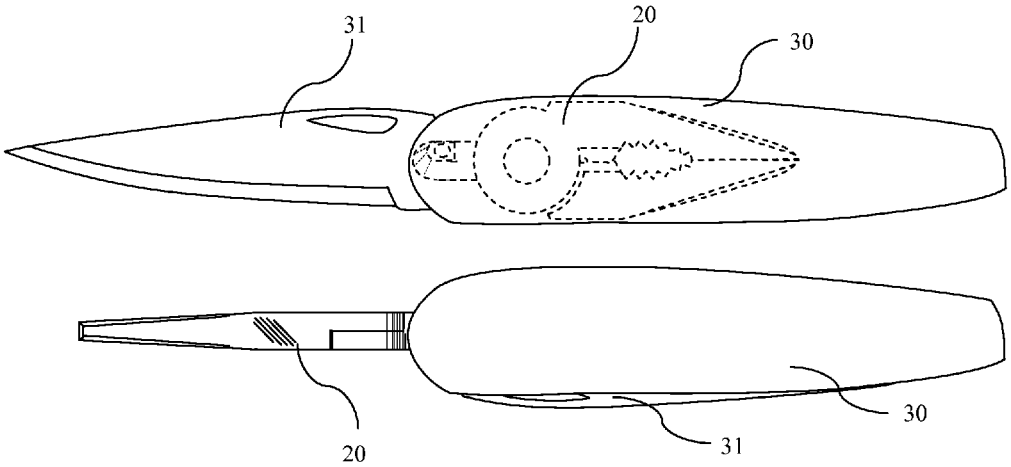
FIG. 12 shows a different embodiment of the tool with some components omitted for clarity, illustrating how this novel method of handle deployment allows the system to maintain the same handle configuration in either open or closed disposition

Once the handles 30 are extended into their open disposition 30A the jaw mechanism is ready to use. The handle movement between closed and opened dispositions is shown in detail in FIG. 8. Accordingly this method of handle deployment can be used on a great variety of tools with or without jaw mechanism or moving parts to separate the distance between handles during deployment as it is shown in detail in FIG. 12 and in the different embodiment shown in FIGS. 19 to 20.

Figure 19:
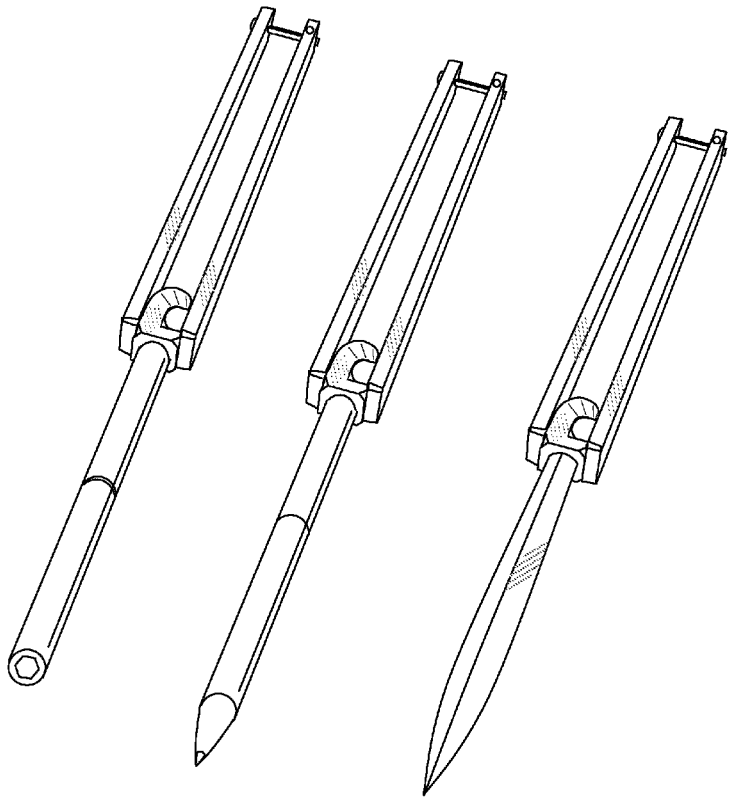
FIG. 19 is a perspective view of some variations of the system showing how this novel method of handle deployment can be applied to a different embodiments without the jaw mechanism for example a driver with removable bits, a writing instrument, a knife, or any other tool in which this novel method may be beneficial and without the need of an opening jaw mechanism to separate the distance between handles pivots during deployment.
Figure 20:
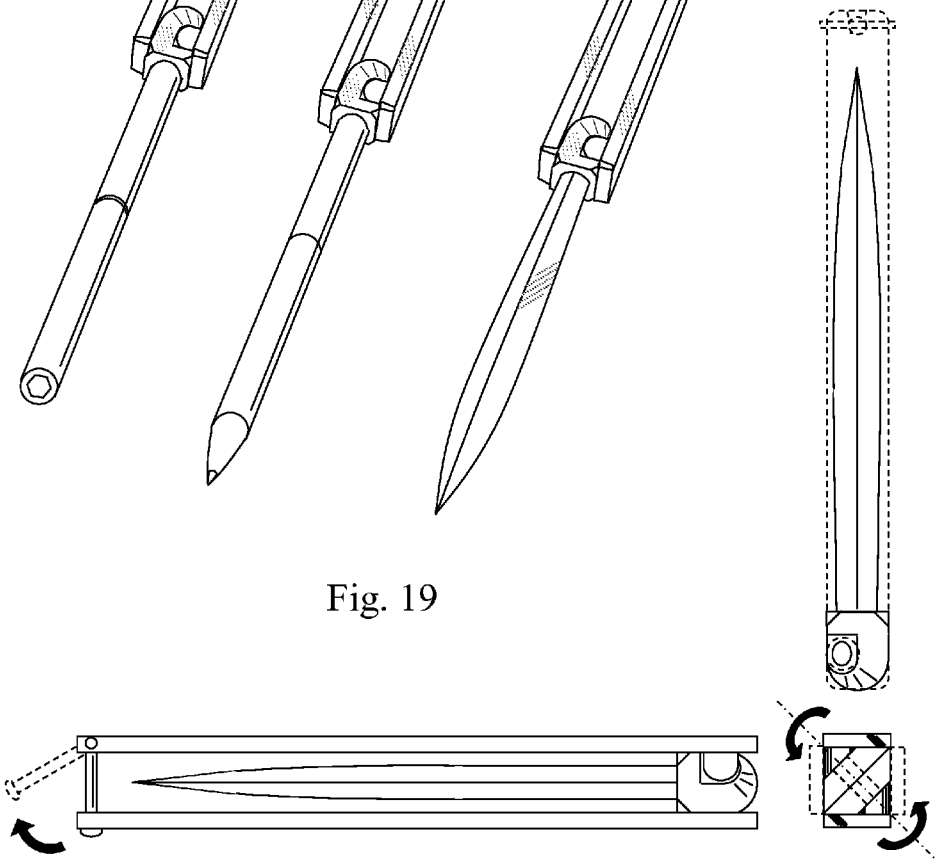
FIG. 20 is a schematic view of a variation shown in FIG. 18 showing how this novel method of handle deployment can be applied to a different embodiments without the jaw mechanism for example tool with removable driver bits, a writing instrument, a knife, or any other tool or combination tool in which this novel method may be beneficial and without the need of an opening jaw mechanism or moving parts to separate the distance between handles pivots during deployment, also this variations presents a different methods for handle locking in open or closed configuration.

The method of use of the system depends entirely on the type of tool head that is employed and the type of operation a user desires. As illustrated only one form is shown with a jaw mechanism with certain variables as illustrated in FIGS. 19 and 20. The system may also include any number of tools and methods of use, for example, dykes, wire cutters, shears, pruning devices, even awls, screwdrivers, wrench devices, hammers and so on.

D. Method of Manufacture

In FIG. 1 of the system the jaw mechanism in a preferred embodiment may be manufactured by metal casting, drop forging, CNC cut, wire EDM, MIM casting or any other methods for fabricating this type of mechanism, other embodiments of the same jaw mechanisms like shears, scissors, thongs, wire cutters, etc. may be manufactured with similar methods or by metal stamping, CNC, wire EDM, drop casting, or any other methods for fabricating this type of mechanisms.

The handles 30 may be manufactured in an array of different methods, for example, channel shaped handles like in most multitools or manufactured in layered manner similar to pocket knives or any other types of suitable embodiments. Likewise the folding tools 31 on each handle may be manufactured by casting, CNC cut, metal stamp, etc. The pivots 25 may be attached to the handles by different methods like soldering, stud welding, screws, rivets, or be integral part of the handles to provide more strength to the mechanism, this may be accomplished by metal casting, drop forging, CNC cut, wire EDM, MIM casting or any other suitable methods for fabricating this type of parts. The jaw cover attachment may similarly be manufactured by any method of metal forming or if made of other materials the process of manufacture will be according to the design and the selected materials.

E. Variations

Figure 13A:
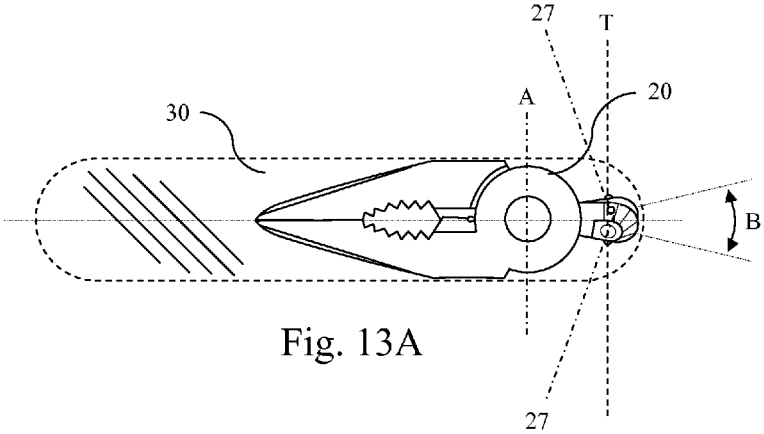
FIG. 13A is a top view of a variation of the system showing a way to modify the angle C between the handles in closed disposition of the system.

FIG. 13A shows a variation in the mechanism that allows the method of handle deployment to modify the angle between handles 30 in the open configuration, this is done by modifying the angle in which the tangs 23 are connected to the jaw mechanism 20, this may involve adjusting the angle B between tangs 23 in more than one axis and accordingly requires adjusting all the pivots, handles and any other part involved, this variation still allows the handle angle 30 to swing from an adjacent position to the jaw mechanism plane A, to a perpendicular position with the jaw mechanism plane only modifying the final separation angle between handles C in open configuration.

Figure 13B:
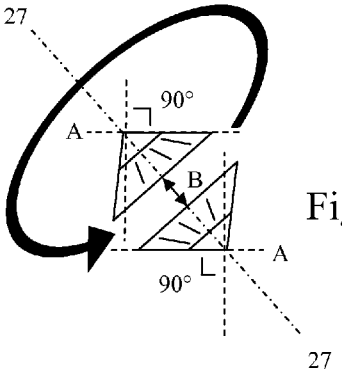
FIG. 13B a traverse cut T from FIG. 13 showing in detail a way to modify the angle C between the handles, describing the movement of the handles from closed to open disposition.

FIG. 13B is a transverse cut T from FIG. 13 showing a detail of the variation in the mechanism that allows the method of handle deployment to modify the angle C between handles 30 in the open configuration, this is done by modifying the angle in which the tangs 23 are connected to the jaw mechanism 20, this may involve adjusting the angle B between tangs 23 in more than one axis and accordingly requires adjusting all the pivots, handles and any other part involved, this variation still allows the handles 30 to swing from an adjacent position to the jaw mechanism plane A, to a perpendicular position with the jaw mechanism plane only modifying the final separation angle between handle angle 30 in open configuration.

Figure 14:
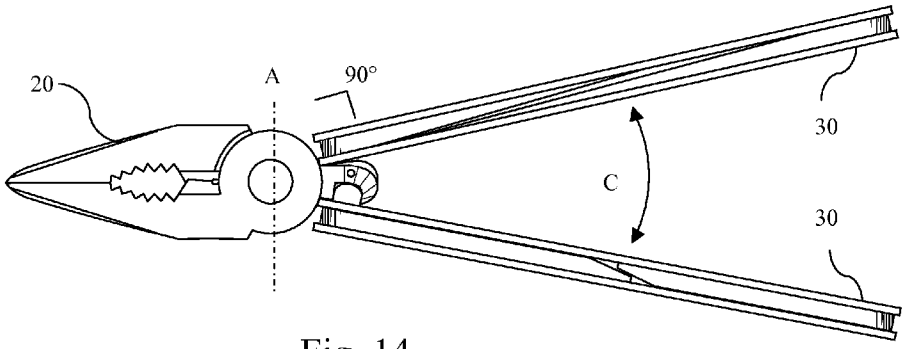
FIG. 14 is a top view of a variation of the system showing a way to modify the angle C between the handles in open disposition of the system.

FIG. 14 Shows a variation in the mechanism that allows the method of handle deployment to modify the angle between handles 30 in the open configuration, this is done by modifying the angle in which the tangs 23 are connected to the jaw mechanism 20, this may involve adjusting the angle B between tangs 23 in more than one axis and accordingly requires adjusting all the pivots, handles and any other part involved. This important variation still allows the handles 30 to swing from an adjacent position to the jaw mechanism, to a perpendicular position with the jaw mechanism plane A, only modifying the final separation angle between handle angle 30 in open configuration.

Figure 15:
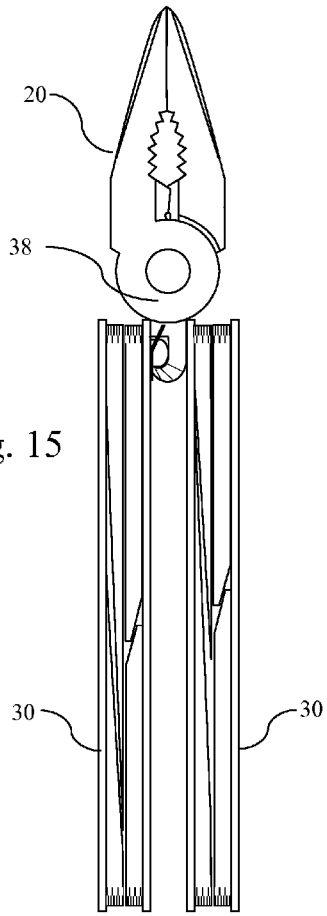
FIG. 15 is a top view of a variation of the system allowing more tools in the handles and handle locking tabs.

FIG. 15 shows a variation of the system with the handles 30 widened for carrying more tools 31 in them. This variation also has a locking tab 38 to help maintain the tool in open configuration.

Figure 16:
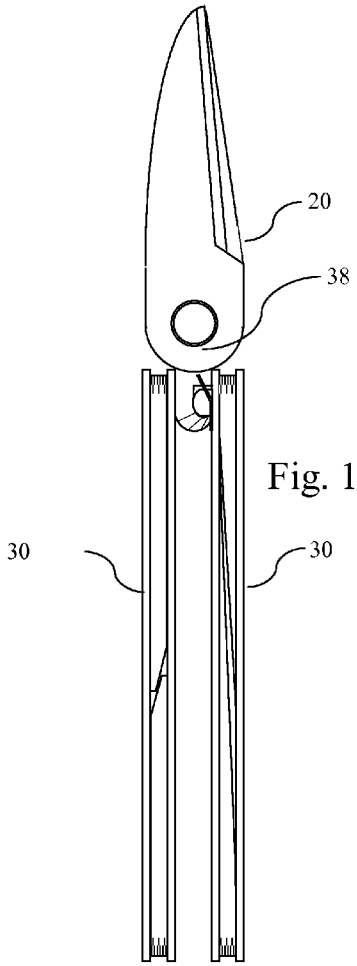
FIG. 16 is a top view of a variation of the system with the jaw mechanism showing a scissors/shears type head and the oppositely handle deployment mechanism reversed from clockwise to counter clockwise and also with locking tabs

FIG. 16 shows a different embodiment of the system with a reverse variation of the method of handle deployment, from clockwise to counter clockwise. This variation shows a different jaw mechanism head of the shears/scissors type, and also has a locking tab 38 to help maintain the tool in open configuration.

Figure 17:
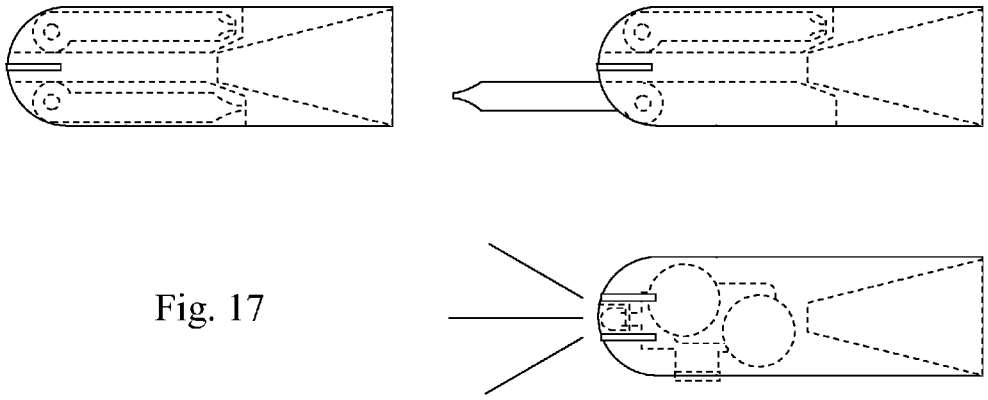
FIG. 17 is a top view of a variation showing different embodiments for a jaw mechanism cover attachment.

FIG. 17 shows some variations in the jaw mechanism cover that allow it to have nested tools available, this tool head cover may also include a flashlight mechanism, other embodiments may include a several different combination of tools and designs.

Figure 18:
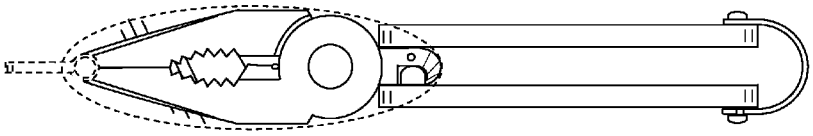
FIG. 18 is a top view of variations of the system without the need of a tool head cover.

In FIG. 18 Shows a different embodiment of the system without the need of a tool head cover. This variation also presents a different method for handle locking in open or closed configuration.

FIG. 19 shows a variation of the system showing how the handle deployment method may be applied to a different embodiment like for example a knife or any other tool or device to which this novel method of handle deployment may be applied without the need of an opening jaw mechanism to separate the distance between handles during deployment. This variation also presents a different method for handle locking in open or closed configuration.

FIG. 20 shows a schematic view of a variation shown in FIG. 18 describing how the handle deployment method may be applied to a different embodiment like for example a knife or any other tool or device to which this novel method of handle deployment may be applied without the need of an opening jaw mechanism to separate the distance between handles during deployment. This variation also presents a different method for handle locking in open or closed configuration.

The spirit of the system provides a breadth of scope that includes all methods of making and using it. The tool head may any number of commonly used tools or new varieties. The tool head may or may not be pivotal, slidable or movable. The method of extracting the tool head may depend on the desired means of use of the tool head itself. The handle may be one or more units, splitable, or already set in pairs. It may even be a cover encapsulating the tool head itself. The construction of the system is wide open to a multitude of desired methods, materials assemblies, and so on. Any variation on the theme and methodology of accomplishing the same that are not described herein would be considered under the scope of the present invention.

What is claimed is:

1. A combination folding tool, comprising:

opposable handles that move from an adjacent position during storage to an extended perpendicular position including pivots of the handles that are angularly offset from each other, and a tool head that is axially positioned during use and is stored between the opposable handles during storage.

2. The tool of claim 1, comprising two articulated actuating blades or jaws and handles.

3. The tool of claim 2, wherein the handles comprise scissors, shears, pliers, or pincers.

4. The tool of claim 1, comprising a jaw mechanism, wherein the jaw and the handles deploy by rotation in opposite directions about pivots attached to or lying in the jaw mechanism.

5. The tool of claim 1, wherein the handles form a multitude of configurations and employ a multitude of different types of tools and tool heads.

6. The tool of claim 1, wherein the jaw mechanism is maintained in a closed configuration and equal to or larger than a regular tool head.

7. The tool of claim 1, wherein the folding tool comprises a multitool.

8. The tool of claim 1, comprising a jaw mechanism in a compact, pocketable form with a pocket knife size.

9. The tool of claim 1, wherein the handles conceal a jaw mechanism in a pocketable form in the open and closed positions without adding extra mechanisms, volume or weight to the tool.

10. The tool of claim 1, comprising locking means to maintain the tool in an open or closed position.

11. The tool of claim 1, wherein the handles are widened to carry other tools therein.

12. The tool of claim 1, wherein the handles are parallel to each other.

13. The tool of claim 1, wherein the handles are separated at an angle.

14. The tool of claim 1, comprising a jaw cover to house other tools therein.

15. A combination folding tool, comprising:

a tool head including:

a jaw mechanism having two jaws lying in a tool head plane, a first attachment lug extending from the jaw mechanism, and a second attachment lug extending from the jaw mechanism;

a first handle mechanism, including:

a first handle attached to the first attachment lug of the tool head, and a first pivot axle lying obliquely to the tool head plane, wherein the first handle is engaged to and rotatable about the first pivot axle in a first direction relative to a tool head plane between a nested position and wherein the first handle is adjacent to the tool head and having a deployed position wherein the first handle is perpendicular to the tool head plane and remote from the two jaws; and a second handle mechanism, including:

a second handle attached to the second attachment lug of the tool head, and a second pivot axle lying obliquely to the tool head plane, wherein the second handle is engaged to and rotatable about the second pivot axle in a second direction relative to the tool head plane between a nested position and wherein the second handle is adjacent to the tool head with a deployed position wherein the second handle is perpendicular to the tool head plane and remote from the two jaws and wherein the pivots of the handles are angularly offset from each other.

16. The combination folding tool of claim 15, comprising pivots of the handles that are collinear.

17. The tool of claim 15, wherein the handles form a multitude of configurations and employ a multitude of different types of tools and tool heads.

18. The tool of claim 15, wherein the jaw is maintained in a closed configuration and equal to or larger than a full-sized tool head.

19. The tool of claim 15, wherein the folding tool comprises a multitool.

20. The tool of claim 15, comprising a strong jaw mechanism in a compact, pocketable form with a pocket knife size.

21. The tool of claim 15, wherein the handles conceal a jaw in a pocketable form in the open and closed positions without adding extra levers, mechanisms, volume or weight to the tool.

* * * * *